US005746012A

United States Patent [19]

Caletti et al.

[11] Patent Number: 5,746,012

[45] Date of Patent: May 5, 1998

[54] WATERPROOF SHOE

[76] Inventors: Diego Caletti, Piazza Cordonega 4, Lazise (VR); Antonio Ferrarese, Via Rimembranza 23, Isola Della Scala (VR), both of Italy

[21] Appl. No.: 597,268

[22] Filed: Feb. 6, 1996

[30] Foreign Application Priority Data

Feb. 21, 1995 [IT] Italy ..... VI9500018 U

[51] Int. Cl.[6] ..... A43B 23/07

[52] U.S. Cl. ..... 36/3 B; 36/3 R; 36/30 R

[58] Field of Search ..... 36/3 R, 3 A, 3 B, 36/25 R, 30 R, 31

[56] References Cited

U.S. PATENT DOCUMENTS

| | | | |
|---|---|---|---|
| 4,071,963 | 2/1978 | Fukuoka | 36/3 B |
| 4,292,746 | 10/1981 | Delaney | 36/83 |
| 4,507,880 | 4/1985 | Ohashi | 36/3 B |
| 4,599,810 | 7/1986 | Sacre | 36/83 |
| 5,044,096 | 9/1991 | Polegato | 36/25 R |
| 5,426,869 | 6/1995 | Gore et al. | 36/30 R |

FOREIGN PATENT DOCUMENTS

| | | |
|---|---|---|
| 0275644 | 7/1988 | European Pat. Off. . |
| 0382904 | 8/1990 | European Pat. Off. . |
| 1918849 | 12/1969 | Germany . |
| 2830821 | 1/1980 | Germany . |
| 3103230 | 1/1982 | Germany . |

*Primary Examiner*—M. D. Patterson
*Attorney, Agent, or Firm*—Gary A. Samuels

[57] ABSTRACT

A shoe comprising an inner-sole and a sole, a plurality of microholes being arranged at least through the central portion of both of them, and an inner liner of a material such as Gore-Tex, wherein, between said inner-sole and said sole, a layer is provided of a resilient material, such as corrugated felt.

2 Claims, 1 Drawing Sheet

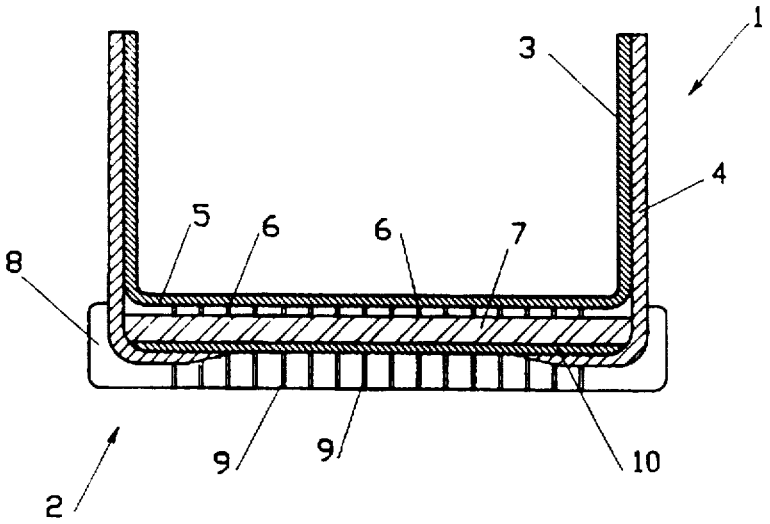
FIG.1
FIG.2
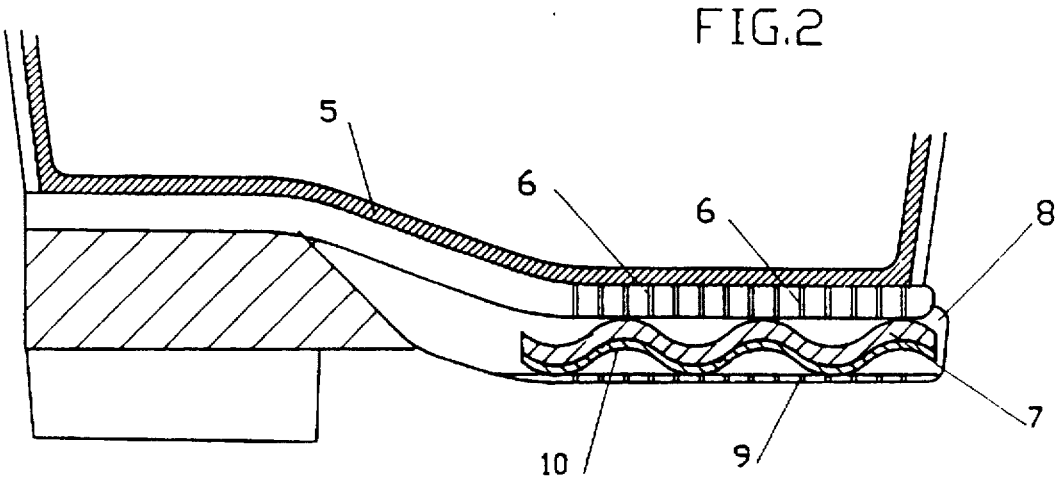

WATERPROOF SHOE

The present invention provides a shoe with impermeable upper and sole permitting outward transpiration, namely a shoe wherein both the sole and the upper permit the passage of vapour caused by foot perspiration, though preventing external liquids from seeping through the upper's walls and the sole itself, wherein means are provided for facilitating air circulation through the walls and the sole of the shoe.

In particular, a shoe is provided in which a transpiring and impermeable material, such as Gore-Tex®, is used properly bonded with other layers of a suitable material, such as leather, rubber, polyurethane, etc., in order to obtain a shoe combining the advantageous characteristics of traditional shoes with regard to comfort, easy manufacture, etc. with the advantageous features of vapour permeability and liquid impermeability. This shoe is characterised in that, between the sole and the mid-sole, it comprises a layer of corrugated felt which, owing to the pressure exerted by the foot while walking, gets resiliently deformed while exerting a certain pumping action facilitating air circulation through this transpiring material and the sole of the shoe.

In the shoe industry, especially in the last few years, the use of synthetic materials, such as rubber, polyurethane, etc. for footwear manufacture has asserted itself more and more.

The use of these materials offers several advantages with regard to production costs, since the most complex and expensive parts, including, in particular, the sole, may be easily obtained, for example, by injecting a plastic material, in order to get well-made and extremely cheap products. However, these shoes, together with various advantages such as considerable lightness, resistance to wear, possibility of combining differently coloured layers, etc., present remarkable drawbacks with regard to hygiene.

The upper of these shoes is usually made of a synthetic fabric, such as nylon, whereas the sole is made of an injected material, generally polyurethane or the like.

However, the use of an impermeable material, such as polyurethane, for making the sole stops transpiration, thus facilitating vapour condensing inside the shoe, with the consequent formation of fungi and bad smells, whereas the fact that the upper is made of fabric permits the passage of liquids; therefore, in case it should rain or the road should be wet, water may penetrate into the shoe, thus causing considerable troubles for the user.

EPA No. 0 275 644 discloses a shoe, the inside of which is coated, both on the sole and the upper, with a layer of Gore-Tex®, in order to make the shoe impermeable, without, however, stopping transpiration.

EP No. 0 382 904 discloses a shoe in which a layer of an impermeable and transpiring material, such as Gore-Tex®, is provided between the sole and the inner-sole, both said sole and said inner-sole having a plurality of holes for permitting outward transpiration.

The present invention falls within this field, since it provides an improved shoe being characterised in that it comprises, between the sole and the Gore-Tex® layer, a further layer made of a resiliently deformable material, in particular a layer of corrugated felt which, on getting deformed as a result of foot pressure, has a pumping effect which facilitates and increases air circulation through the sole, thus considerably increasing the benefits deriving from the use of Gore-Tex®.

More particularly, the sole of the shoe according to the invention has a plurality of microholes and, between the sole and the layer of a transpiring material, a properly shaped material (for example corrugated felt) is provided which, on getting resiliently deformed, exerts this pumping action which can facilitate and increase transpiration.

Then an object of the invention is to provide a shoe combining the advantageous characteristics of traditional footwear, i.e. low production costs, hygiene, etc., with the advantages of perfect transpiration and absolute liquid impermeability.

A further object of the invention is to provide a shoe which may be manufactured with the traditional methods, without having to use any special equipment.

The present invention will now be described in detail, just by way of non limiting example, with reference to the accompanying drawings in which:

FIG. 1 is a diagrammatic section of a shoe according to the invention, in which the different layers forming the upper and the sole of the shoe are shown;

FIG. 2 is a diagrammatic section of the sole of a shoe according to the invention.

With reference to FIG. 1, numerals 1 and 2 indicate the upper and the sole of a shoe respectively.

According to the invention, the inside of the shoe has a layer 3 made of a transpiring and impermeable material, in particular a material such as Gore-Tex®, which is bonded to upper 4 and an inner-sole 5, the latter being provided with a plurality of holes 6.

The upper and the inner-sole may be made, for example, of hide, leather, a synthetic and/or natural fabric or any other suitable material.

Under inner-sole 5 there is provided a properly shaped layer 7, made of a suitable material, for example polypropylene corrugated felt, such as to have a certain degree of resiliency to exert, as a result of foot pressure when walking, a certain pumping effect which facilitates air circulation through the various layers forming the sole.

The tread or outsole 8 of said sole 2 is provided with a plurality of holes 9, for permitting the passage of water vapour being produced by foot transpiration from the inside of the shoe to the outside.

Between tread 8 and felt layer 7 there is provided a further layer 10 made of an impermeable and transpiring material such as Gore-Tex®, which serves to protect the felt layer against liquids which might seep through holes 9.

Gore-Tex® layer 10 is properly fixed to the shoe, in particular only on the edge of layer 7, just to prevent glue from obstructing holes 9 and hindering the free passage of vapour.

Preferably, in case of gluing a discrete number of glue dots is used, so as not to hinder the passage of vapour from the inside of the shoe to the outside.

Furthermore, the Gore-Tex® layer may be fixed by sewing or any other suitable method.

Felt 7 acts both as a deformable element, favouring the user's comfort, and to exert a certain pumping action, as already mentioned above.

As a matter of fact, while walking, layer 7 gets deformed and flat, after which it recovers its former shape when the foot is lifted, thus exerting that pumping action which facilitates the passage of air through the sole, ensuring good ventilation.

A shoe made of hide or leather may be manufactured with conventional techniques, by combining sewing and gluing methods, whereas shoes made of polyurethane or any other synthetic material may be manufactured with the common injection moulding techniques.

A shoe is thus provided which, besides combining the advantageous characteristics of traditional shoes, though at the same time permitting the passage of water vapour from the inside of the shoe to the outside as well as absolute impermeability, offers the advantage of providing means which, by ensuring ventilation through the sole, improve this transpiration effect, thus increasing the user's comfort.

We claim:

1. A shoe having an inner sole and an outer sole, wherein the inner sole has on its upper surface a liquid water impermeable material that permits passage of water vapor;

wherein between said inner sole and outer sole, there is resilient material that has on its side adjacent the outer sole, a liquid water impermeable material permits passage of water vapor;

wherein said inner sole has a plurality of microholes through the inner sole; and wherein said outer sole has a plurality of microholes through the outer sole.

2. The sole of claim 1, where the resilient material has a corrugated configuration.

* * * * *